US012085360B1

(12) United States Patent
Huang

(10) Patent No.: US 12,085,360 B1
(45) Date of Patent: Sep. 10, 2024

(54) CAM LOCKING AND POSITIONING STRUCTURE

(71) Applicant: Wen-Shao Huang, Taichung (TW)

(72) Inventor: Wen-Shao Huang, Taichung (TW)

( * ) Notice: Subject to any disclaimer, the term of this patent is extended or adjusted under 35 U.S.C. 154(b) by 21 days.

(21) Appl. No.: 18/131,873

(22) Filed: Apr. 7, 2023

(51) Int. Cl.
*F41C 27/00* (2006.01)
*F41C 23/16* (2006.01)

(52) U.S. Cl.
CPC ..... *F41C 27/00* (2013.01); *F41C 23/16* (2013.01)

(58) Field of Classification Search
CPC ..... F41C 27/00; F41C 23/16
See application file for complete search history.

(56) References Cited

U.S. PATENT DOCUMENTS

| | | | | |
|---|---|---|---|---|
| 7,814,698 | B2 * | 10/2010 | Fluhr | F41G 1/26 42/111 |
| 9,239,209 | B2 * | 1/2016 | Mayberry | F41G 11/005 |
| 9,341,441 | B2 * | 5/2016 | Cheng | F41G 11/001 |
| 9,423,216 | B2 * | 8/2016 | Cheng | F41C 23/16 |
| 9,772,161 | B1 * | 9/2017 | Cheng | F41G 11/004 |
| 9,777,985 | B2 * | 10/2017 | Roberts | F41C 27/00 |
| 10,088,270 | B1 * | 10/2018 | Oglesby | F41C 27/00 |
| 10,101,126 | B2 * | 10/2018 | Sharron | F41G 11/003 |
| 10,240,901 | B1 * | 3/2019 | Cheng | F41A 35/00 |
| 10,288,376 | B2 * | 5/2019 | Gottzmann | F41G 11/003 |
| 10,393,465 | B2 * | 8/2019 | Cheng | F41A 23/10 |
| 10,551,145 | B2 * | 2/2020 | Kincel | F41C 23/16 |
| 10,557,681 | B2 * | 2/2020 | Cahill | F41C 27/00 |
| 10,571,218 | B2 * | 2/2020 | Cahill | F41C 27/00 |
| 10,724,569 | B2 * | 7/2020 | Windfeldt | F16B 33/02 |
| 10,996,023 | B2 * | 5/2021 | Roberts | F41C 27/00 |
| 11,029,131 | B2 * | 6/2021 | Cahill | F41G 11/003 |
| 11,105,494 | B2 * | 8/2021 | Ma | F21L 4/00 |
| 11,125,530 | B2 * | 9/2021 | Kincel | F41C 23/16 |
| 11,752,596 | B2 * | 9/2023 | Stabler | F41G 11/003 248/229.16 |
| 11,761,734 | B2 * | 9/2023 | Chen | F41G 11/003 42/114 |
| 11,839,959 | B2 * | 12/2023 | Stabler | F16B 2/185 |
| 11,976,899 | B1 * | 5/2024 | Skelton | F41C 27/00 |
| 2016/0209175 | A1 * | 7/2016 | Sharron | F41G 11/003 |
| 2020/0208946 | A1 * | 7/2020 | Cahill | F41G 11/001 |
| 2021/0293512 | A1 * | 9/2021 | Duncan, III | F41G 11/003 |
| 2023/0272811 | A1 * | 8/2023 | Stabler | F16B 2/185 248/205.1 |

* cited by examiner

*Primary Examiner* — Michelle Clement
(74) *Attorney, Agent, or Firm* — Leong C. Lei

(57) ABSTRACT

A cam locking and positioning structure is specifically designed form an M-LOK rail and mainly includes a main body for connection with various different devices, and a cam wrench and a tightening axle combinable with the main body. The main body has a through hole, and positioning portions raised from a top thereof. The cam wrench includes symmetrically arranged lugs, and a wrenching part extending from the lugs. The lugs include fixing holes, and rounded projection portions are formed on tops of the lugs. The tightening axle is of a T-shape having a vertical section having an elongated hole. The tightening axle is insertable into the through hole of the main bod, and a pin is inserted into the fixing holes of the lugs of the cam wrench and the elongated hole of the tightening axle to set the cam wrench in a pullable manner.

4 Claims, 9 Drawing Sheets

CAM LOCKING AND POSITIONING STRUCTURE

TECHNICAL FIELD OF THE INVENTION

The present invention relates to a cam locking and positioning structure, and more particularly to a cam locking and positioning structure that is designed specifically for an M-LOK (abbreviation of Modular Lock) rail to make use of rotating and pressing of a cam wrench to fix various devices on an object-to-be-clamped.

DESCRIPTION OF THE PRIOR ART

M-LOK, of which the license is free of charge, is a "negative space" (hollow slot) firearm rail interface system developed and patented by Magpul Industries. Magpul revealed a prototype of MOE slot in 2007 for Masada Concept Rifle, and officially released, in 2009, the MOE handguard, and compatible accessories, such as Picatinny rail section, mount for tactical light, scope, electronic switch, or grenade, grip, bipod stud. However, the MOE design has a drawback that the rear side of the handguard has to be accessed in order to mount the accessories, making it unsuitable for applications on free-floating handguards. Further, the spacing increment between the MOED slots is excessively wide or is not uniform, so as to limit the selection of mounting position of accessories. In view of such situations, Magpul redesigned the M-LOK system for full substitution of the MOE design in 2014. The M-LOK rail adopts metric dimensions to take the place of the imperial system. However, the currently available M-LOK rail requires screws for locking and fixing, and thus tools must be used to mount or dismount. Mounting and dismounting are tedious and time- and labor-consuming, and cause trouble to general users.

In view of the above, the present invention aims to provide a cam locking and positioning structure, which is designed specifically for an M-LOK rail to allow various devices to be fixed, by means of rotating and pressing achieved with a cam wrench, to an object-to-be-clamped that includes an M-LOK rail, in order to make mounting of attachable devices easy and efficient.

SUMMARY OF THE INVENTION

The primary objective of the present invention is to provide a cam locking and positioning structure, which is designed specifically for an M-LOK rail to allow various devices to be fixed through an easy operation, by means of rotating and pressing achieved with a cam wrench, to an object-to-be-clamped that includes an M-LOK rail, in order to make mounting of attachable devices easy and efficient.

The cam locking and positioning structure comprises a main body for connection with various different devices or components, and a cam wrench and a tightening axle combinable with the main body. The main body is formed with a through hole, and has a top that is formed with positioning portions raised therefrom. The cam wrench comprises lugs that are symmetrically arranged, and a wrenching part extending from the lugs. The lugs are each formed with a fixing hole, and the lugs are each provided, on a top thereof, with a rounded projection portion having a predetermined height. The tightening axle is generally of a T-shape, which comprises a vertical section that is formed with an elongated hole. The tightening axle is insertable into and receivable in the through hole of the main body, and a pin is inserted into the fixing holes of the lugs of the cam wrench and the elongated hole of the tightening axle to set the cam wrench in a pullable manner. To use, the tightening axle is inserted into an object-to-be-clamped, and set in position by means of the positioning portions of the main body. Rotating and pressing of the cam wrench are then conducted to have the rounded projection portions pushing against the main body, to have the tightening axle and the main body clamping against the object-to-be-clamped to thereby fixing the device or component connected to the main body on the object-to-be-clamped.

In the above-described cam locking and positioning structure, the main body is provided, in a bottom thereof, with a fitting trough of a circular arc configuration, so that the rounded projection portions on the tops of the lugs of the cam wrench are fit into the fitting trough to achieve positioning.

In the above-described cam locking and positioning structure, the main body comprises a block portion, and a plate portion extending from the block portion, and the through hole is formed in the plate portion.

In the above-described cam locking and positioning structure, the tightening axle is generally of a T-shape including a horizontal section and a vertical section. The vertical section is provided, in a bottom portion thereof, with a threaded hole. After the tightening axle is inserted into the through hole of the main body and a pin is inserted into the fixing holes of the lugs and the elongated hole, a bolt is screwed into the threaded hole to retain the pin in position.

DETAILED DESCRIPTION OF THE PREFERRED EMBODIMENT

Figure 1:
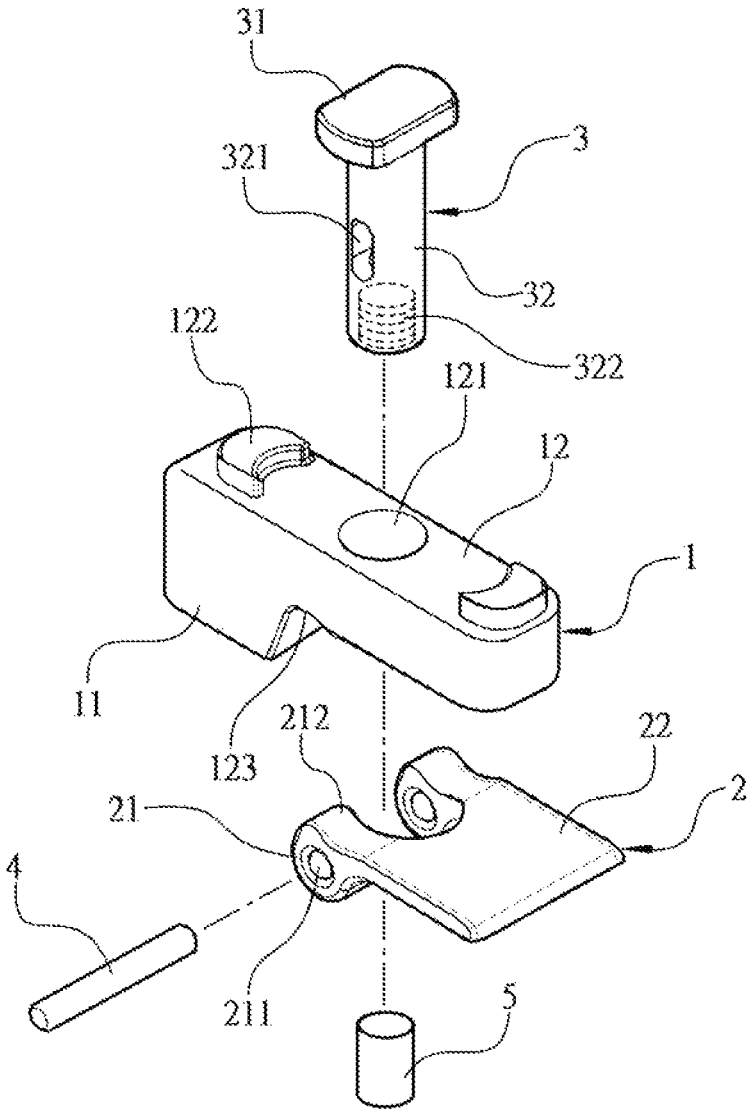
FIG. 1 is an exploded view showing the present invention.
Figure 2:
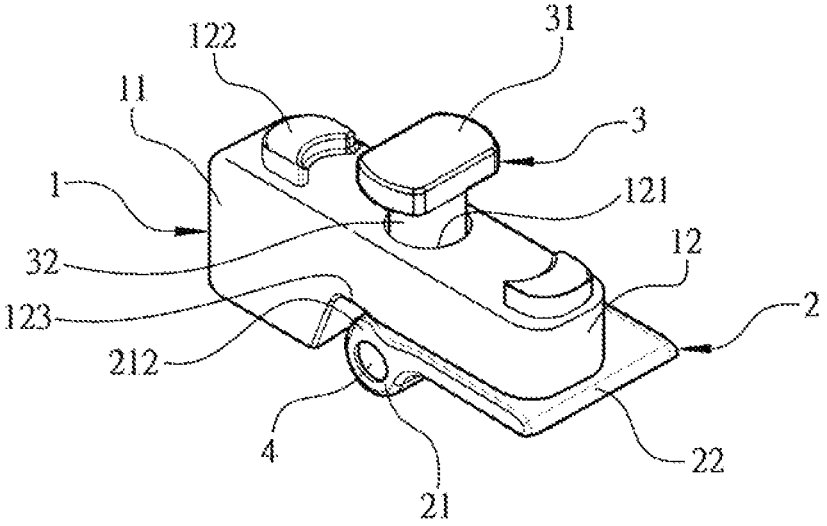
FIG. 2 is a perspective view showing the present invention.
Figure 3:
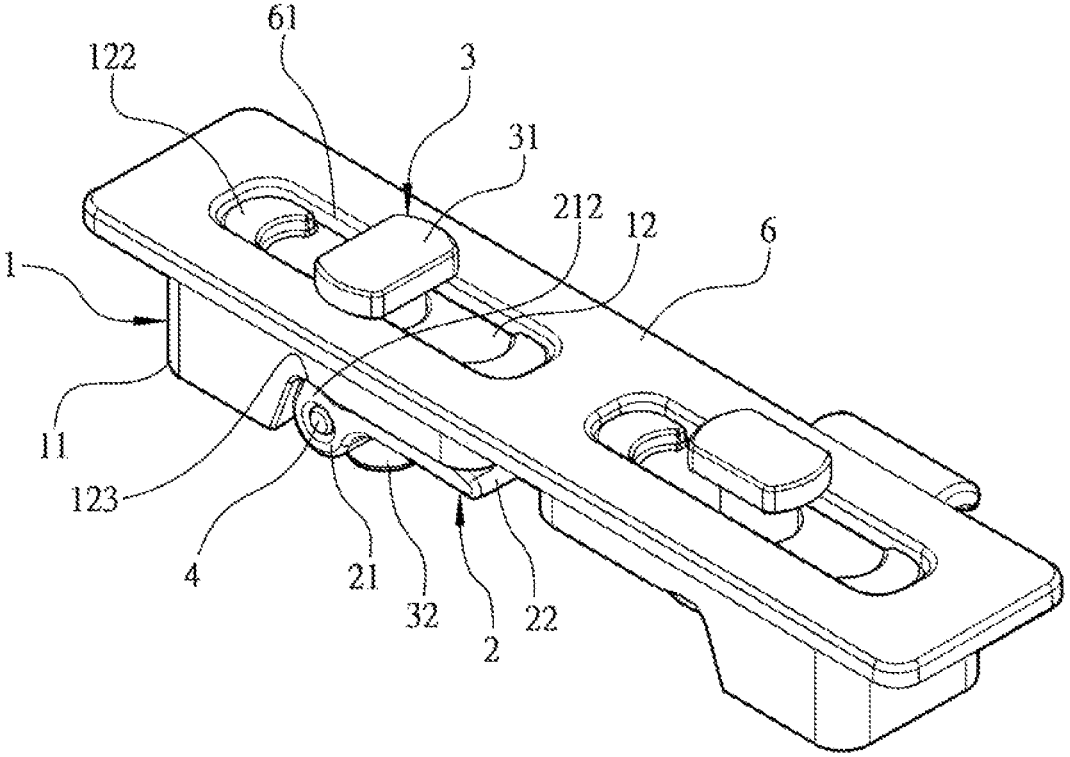
FIGS. 3-5 are schematic views showing an application of assembling of the present invention to a toy gun barrel.
Figure 4:
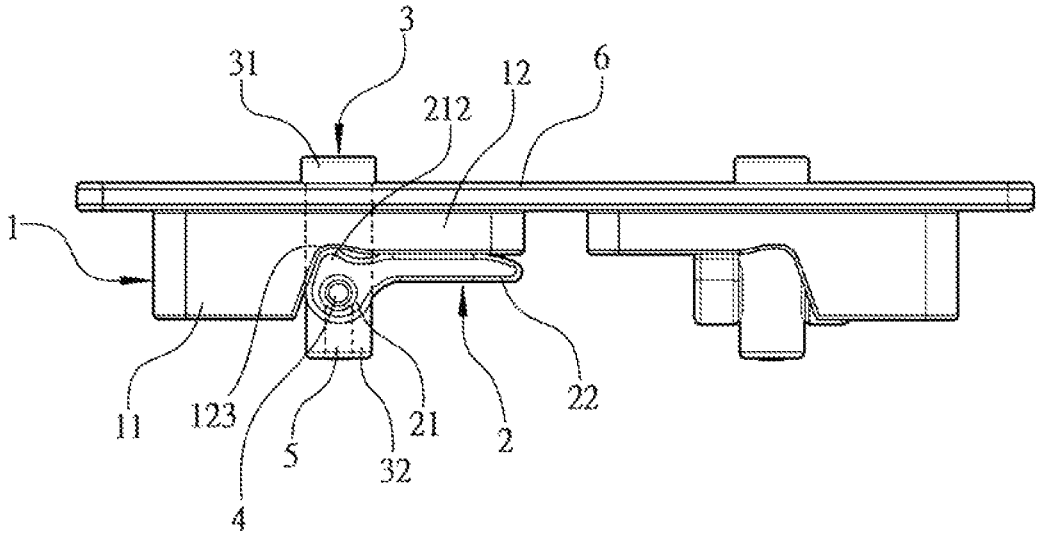
Figure 5:
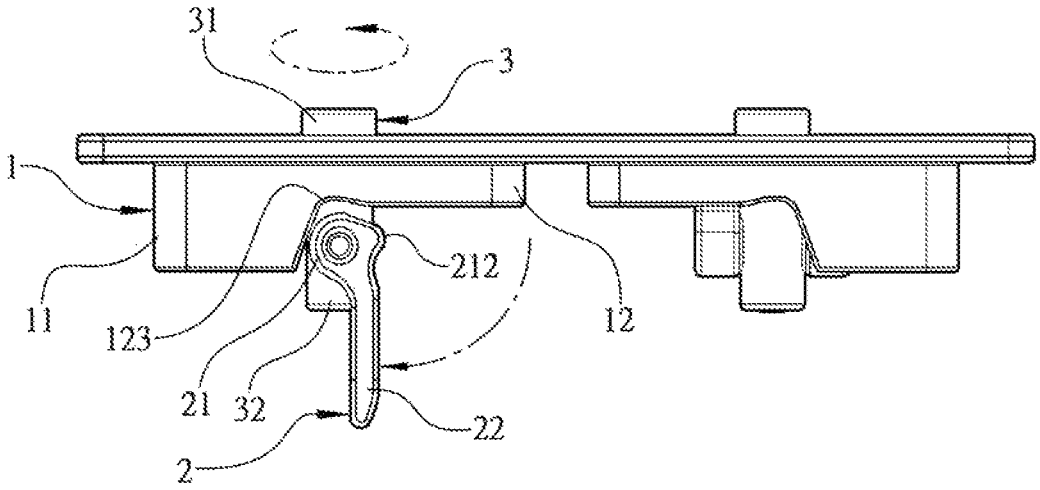
Figure 6:
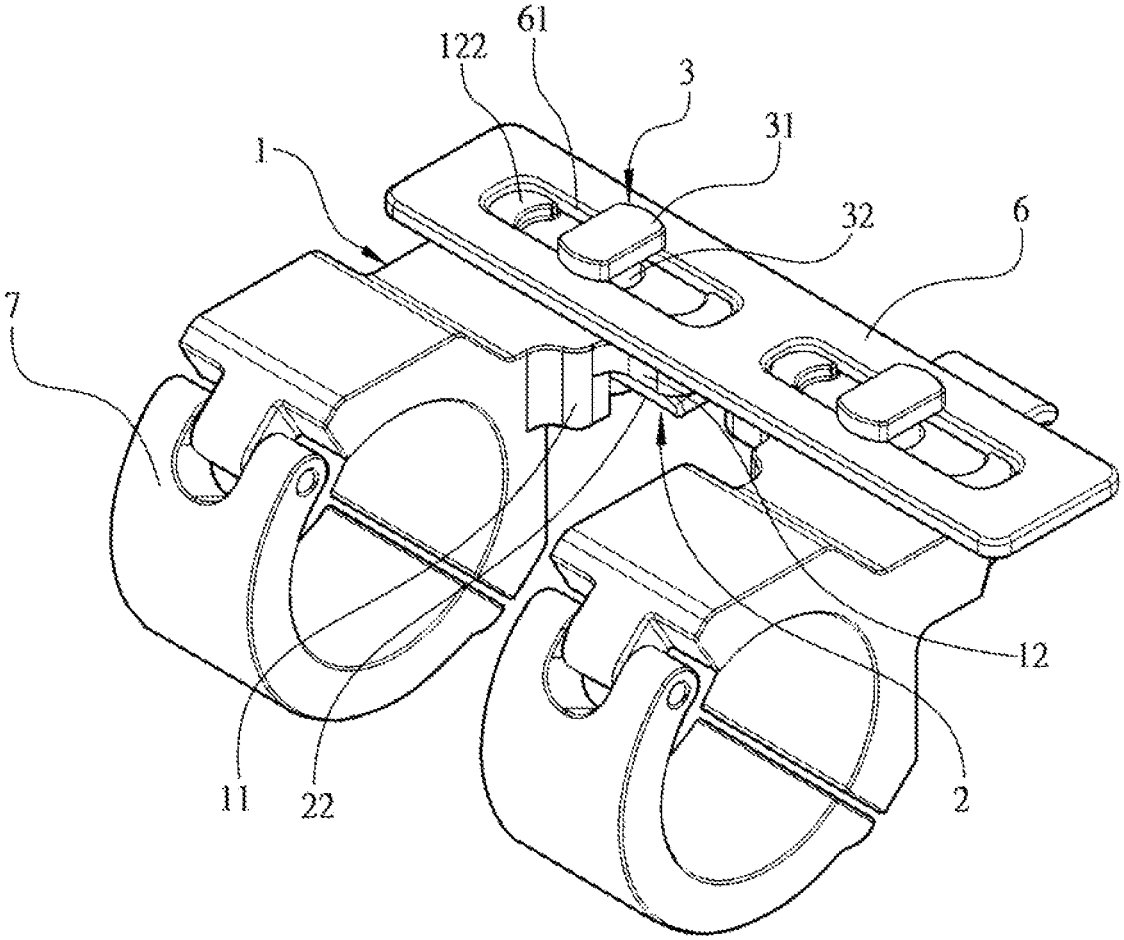
FIG. 6 is a perspective view showing the present invention assembled on a toy gun barrel.

Referring to both FIGS. 1 and 2, which are respectively an exploded view and a perspective view of the present invention, as shown in the drawings, the present invention comprises a main body 1 for connection with various different devices or components, and a cam wrench 2 and a tightening axle 3 mounted to the main body 1. The main body 1 is formed with a block portion 11, and a plate portion 12 extending from the block portion 11. The plate portion 12 is formed with a through hole 121 and has a top that is provided, respectively on two side portions thereof, with positioning portions 122, and a bottom that is provided, at a suitable location, with a fitting trough 123 of a circular arc configuration. In the instant embodiment, the positioning portions 122 are spaced from a circumference of the plate portion 12 by a proper distance.

The cam wrench 2 comprises lugs 21 that are symmetrically arranged, and a wrenching part 22 extending from the lugs 21. The lugs 21 are each formed with a fixing hole 211, and the lugs 21 are each provided, on a top thereof, with a rounded projection portion 212 having a proper height.

The tightening axle 3 is generally of a T-shape having a horizontal section 31 and a vertical section 32. The vertical section 32 is formed with an elongated hole 321, and the vertical section 32 is provided, in a bottom portion thereof, with a threaded hole 322.

The tightening axle 3 is inserted into and received in the through hole 121 of the main body 1, and a pin 4 is inserted into and retained in the fixing holes 211 of the lugs 21 of the cam wrench 2 and the elongated hole 321 of the tightening axle 3, and a bolt 5 is screwed into the threaded hole 322 in the bottom portion of the vertical section 32 of the tightening axle 3 to retain the pin 4 in position so as to make the cam wrench 2 in a wrenchable or pullable manner.

Through combination of the previously-described components, a cam locking and positioning structure is formed. To use, the horizontal section 31 on a top portion of the tightening axle 3 is inserted into an object-to-be-clamped that includes an M-LOK rail, and is set in position by means of the positioning portions 122 of the main body 1. Rotating and pressing of the cam wrench 2 are then conducted to have the rounded projection portions 212 pushing against the fitting trough 123 of the main body 1 to make the tightening axle 3 and the main body 1 tightly clamping the object-to-be-clamped, so as to have a device or component that is connected to the main body 1 fixed on the object-to-be-clamped. To dismount, the cam wrench 2 is pulled and rotated backward to allow the tightening axle 3 to disengage and detach from the object-to-be-clamped, so as to remove the cam locking and positioning structure.

In the present invention, the fitting trough 123 that is described previously as being formed in the bottom of the plate portion 12 of the main body 1 can be arranged in a horizontal direction or a vertical direction, and the difference is only that the direction in which the rounded projection portions 212 of the cam wrench 2 push against the fitting trough 123 of the main body 1 is different. For both horizontal and vertical arrangements of the fitting trough 123, the purposes of fixing the main body 1 on the object-to-be-clamped can be achieved.

Referring simultaneously to FIGS. 3-6, which are schematic views showing assembling of the present invention on a toy gun barrel, as shown in the drawings, when the present invention is used to attach a mount for a tactical light, a scope, an electronic switch, or a grenade to a barrel 6 (the object-to-be-clamped) of a gun or a toy gun that includes an M-LOK rail, a clamp 7 is mounted to the main body 1, and the mounting is implemented such that the horizontal section 31 on the top end of the tightening axle 3 is inserted into an elongated hole 61 of the barrel 6 (for a metric system M-LOK rail). After the insertion of the horizontal section 31, the cam wrench 2 is rotated toward a 90-degree direction to cause the horizontal section 31 to correspondingly rotate therewith in the same direction, and then the cam wrench 2 is pressed in a direction toward the main body 1, in such a way that the rounded projection portions 212 on the tops of the lugs 21 are fit into the fitting trough 123 in the bottom of the main body 1 to achieve an effect of positioning so as to have the horizontal section 31 set in a horizontal direction and clamp against the barrel 6, thereby fixing the clamp 7 on the barrel 6, wherein the clamp 7 allows for mounting of a device or component, such as a scope, a flashlight or an electronic switch or a grenade thereon. To dismount, it only needs to pull up the cam wrench 2 to release the horizontal section 31 on the top end of the tightening axle 3 from the barrel 6, and then rotating the cam wrench 2 reversely to have the cam locking and positioning structure disengage and separate from the barrel 6 for removal, and thus the attached device or component is removed from the barrel 6.

Figure 7:
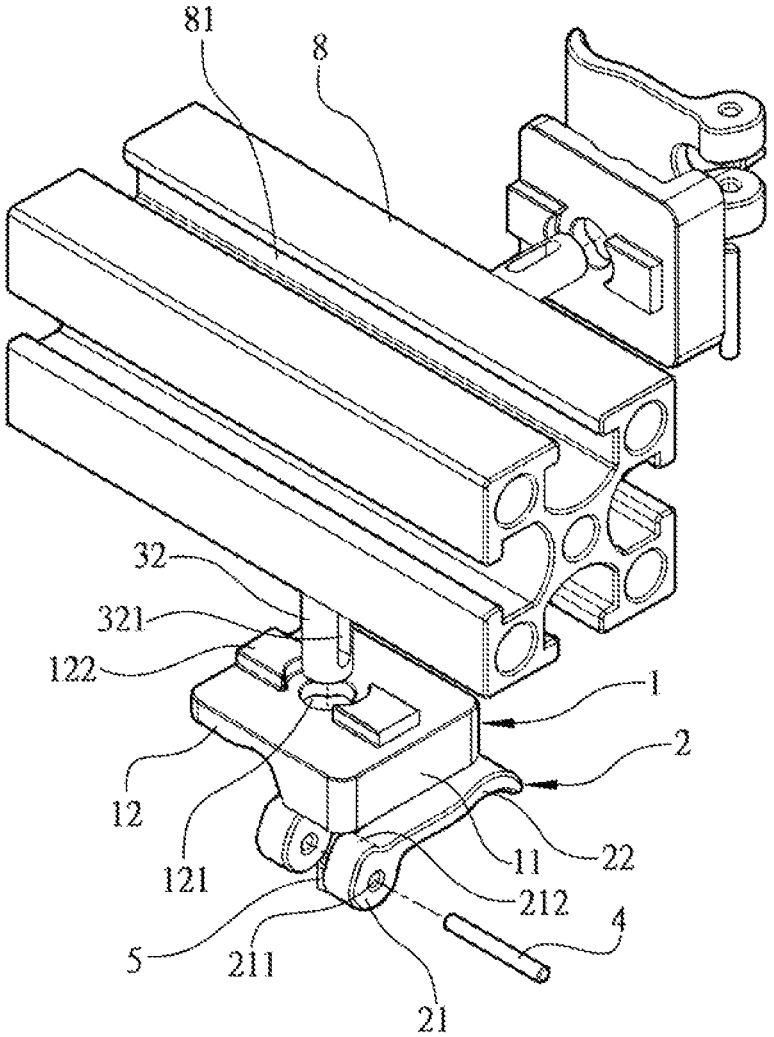
FIGS. 7 and 8 are schematic views showing an application of assembling of the present invention to an aluminum extrusion.
Figure 8:
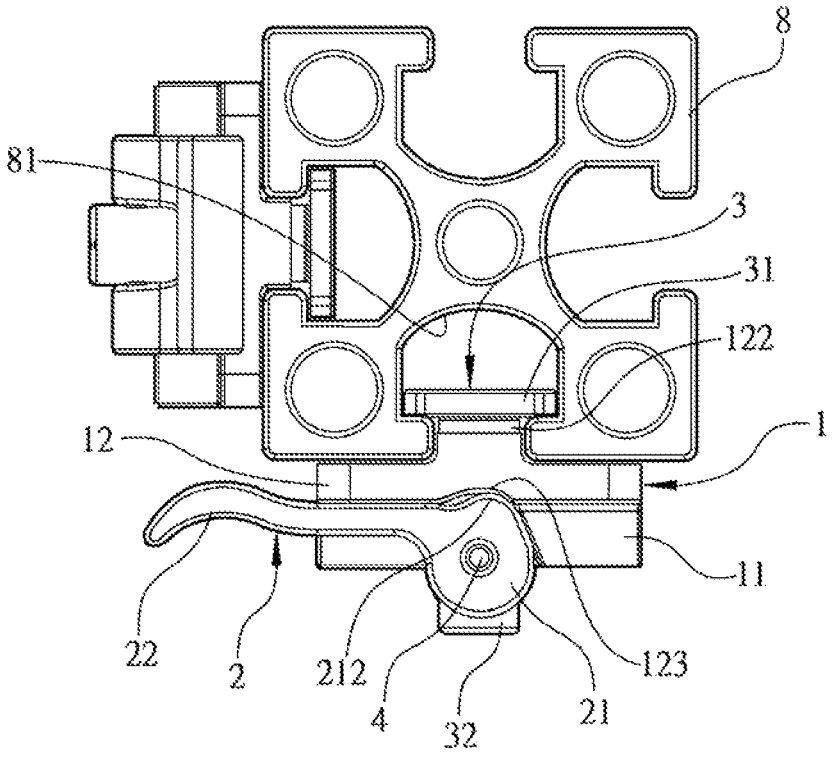

Referring simultaneously to FIGS. 7 and 8, which are schematic views showing assembling of the present invention to an aluminum extrusion, as shown in the drawings, the present invention is applicable to an aluminum extrusion 8 (the object-to-be-clamped) in a manufacturing line of a factory, and the aluminum extrusion 8 is of an M-LOK rail design. To assemble, the horizontal section 31 on the top end of the tightening axle 3 is inserted into a channel 81 of the aluminum extrusion 8, and after the insertion of the horizontal section 31, the cam wrench 2 is rotated toward a 90-degree direction to cause the horizontal section 31 to correspondingly rotate therewith in the same direction, and then the cam wrench 2 is pressed in a direction toward the main body 1, in such a way that the rounded projection portions 212 on the tops of the lugs 21 are fit into the fitting trough 123 in the bottom of the main body 1 to achieve an effect of positioning so as to have the horizontal section 31 set in a horizontal direction and clamp against an inner side of the channel 81, thereby fixing the main body 1 on the aluminum extrusion 8 to allow the main body 1 to mount various different devices or components. To dismount, it only needs to pull up the cam wrench 2 to release the horizontal section 31 on the top end of the tightening axle 3 from the channel 81, and then rotating the cam wrench 2 reversely to have the cam locking and positioning structure disengage and separate from the channel 81 for removal, and thus the attached device or component is removed from the aluminum extrusion 8.

Figure 9:
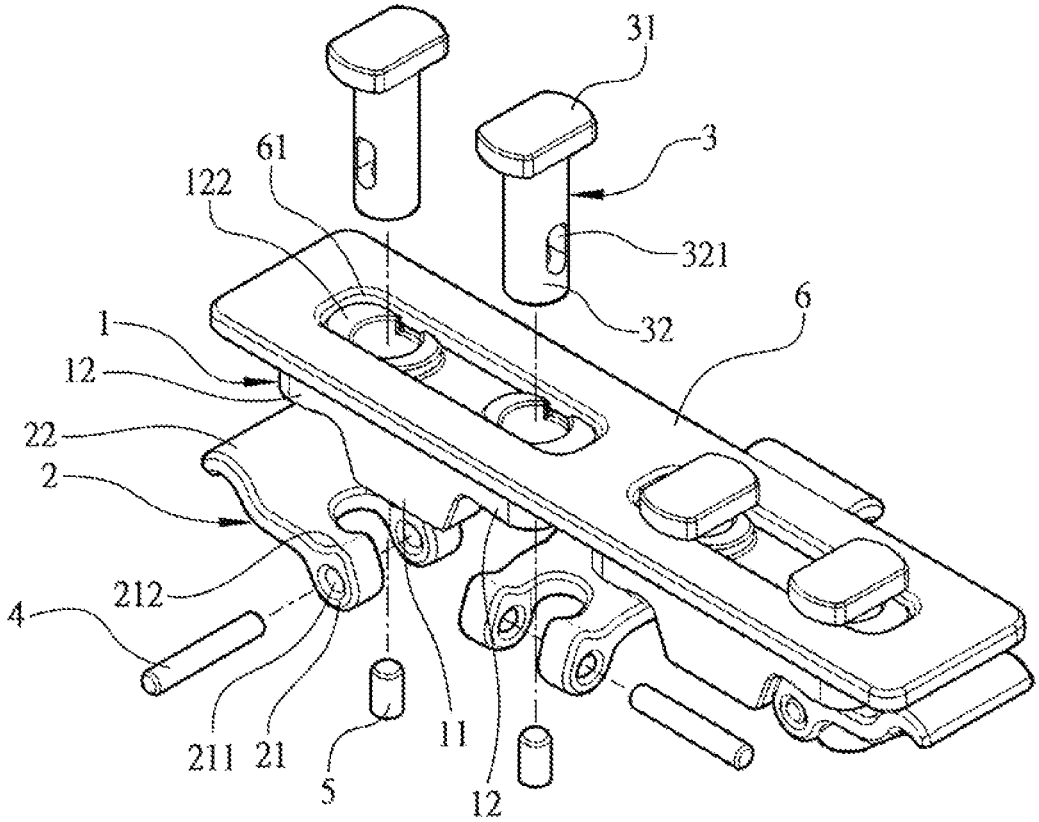
FIG. 9 is a schematic view showing another example of assembling of the present invention.

Referring to FIG. 9, which is a schematic view showing another example of assembling of the present invention, as shown in the drawing, the present invention is structured such that the main body 1 is formed as a block portion 11, and two plate portions 12 extending from two sides of the block portion 11, and the plate portions 12 are each provided with a through hole 121 and raised positioning portions 122 and are each provided, in a bottom thereof at a suitable location, with a fitting trough 123 of a circular arc configuration. To assemble, similarly, the horizontal section 31 on the top end of the tightening axle 3 is inserted into an object-to-be-clamped, and after the insertion of the horizontal section 31, the cam wrench 2 is rotated toward a 90-degree direction to cause the horizontal section 31 to correspondingly rotate therewith in the same direction, and then the cam wrench 2 is pressed in a direction toward the main body 1, in such a way that the rounded projection portions 212 on the tops of the lugs 21 are fit into the fitting trough 123 in the bottom of the main body 1 to achieve an effect of positioning so as to have the horizontal section 31 set in a horizontal direction and clamp against the object-to-be-clamped, thereby having the main body fixed to the object-to-be-clamped to allow the main body 1 to mount various different devices or components.

In summary, the present invention provides a main body that includes a through hole and positioning portions to be used in combination with a tightening axle and a cam wrench connectable to the main body to form a cam locking and positioning structure. As such, various different devices or components can be mounted, through an easy operation by means of rotating and pressing of the cam wrench, to an object-to-be-clamped having an M-LOK rail design. Thus, the mounting of an attached device or component is made easy and efficient.

I claim:

1. A cam locking and positioning structure, which is specifically designed for a Modular Lock (M-LOK) rail, and comprises:

a main body, which is adapted to connect with various different components and which is formed with one or more than one through holes, and has a bottom that is formed with a fitting trough of a circular arc configuration;

a cam wrench, which comprises lugs that are symmetrically arranged, and a wrenching part extending from the lugs, the lugs being formed with a fixing hole, the lugs being provided, on a top thereof, with a rounded projection portion having a predetermined height; and a tightening axle, which comprises a horizontal section and a vertical section, the vertical section being formed with an elongated hole, the vertical section being provided, in a bottom portion thereof, with a threaded hole, wherein the tightening axle is insertable into the through hole of the main body, and a pin is insertable into and receivable in the fixing holes of the lugs of the cam wrench and the elongated hole, a bolt being screwable into the threaded hole to retain the pin in position, so as to set the cam wrench in a pullable manner for assembling of an object-to-be-clamped including an arrangement of the M-LOK rail.

2. The cam locking and positioning structure according to claim 1, wherein the main body comprises a block portion, and a plate portion extending from the block portion, the through hole being formed in the plate portion, the fitting trough being formed in a bottom of the plate portion.

3. The cam locking and positioning structure according to claim 2, wherein positioning portions are respectively formed on and raised from two side portions of a top of the plate portion of the main body for positioning of the object-to-be-clamped in the assembling thereof.

4. The cam locking and positioning structure according to claim 2, wherein the fitting trough that is formed in the bottom of the plate portion of the main body is arranged in a horizontal direction or a vertical direction.

* * * * *